US005459937A

United States Patent [19]

Albin et al.

[11] Patent Number: 5,459,937

[45] Date of Patent: Oct. 24, 1995

[54] MAT BOARD CUTTING GUIDE

[76] Inventors: Stephen D. Albin, 610 Rancho; Michael T. Albin, 797 Manor Way, both of Los Altos, Calif. 94024

[21] Appl. No.: 294,375

[22] Filed: Aug. 23, 1994

[51] Int. Cl.[6] ..... B43L 7/02; B26D 7/01

[52] U.S. Cl. ..... 33/479; 33/427; 33/446; 33/32.3; 33/42

[58] Field of Search ..... 33/32.2, 32.3, 33/42, 474, 479, 427, 478, 446, 464, 481

[56] References Cited

U.S. PATENT DOCUMENTS

| | | | |
|---|---|---|---|
| 1,648,266 | 11/1927 | Grass | 33/478 |
| 3,086,291 | 4/1963 | Harrison | 33/446 |
| 3,343,266 | 9/1967 | Dolgorukov | 33/479 |
| 4,825,559 | 5/1989 | Santos | 33/479 |
| 5,038,487 | 8/1991 | Johnson | 33/481 X |
| 5,309,642 | 5/1994 | McGinnis | 33/32.2 |

FOREIGN PATENT DOCUMENTS

| | | | |
|---|---|---|---|
| 43906 | 9/1910 | Austria | 33/479 |

*Primary Examiner*—Alvin Wirthlin
*Attorney, Agent, or Firm*—Hickman & Beyer

[57] ABSTRACT

A mat board cutting guide for use in cutting mat board for flamed pictures, for example, is disclosed. The cutting guide includes an elongated straight edge having a top and a bottom surface, a first and a second end, and a first and a second edge. The first and the second edge are parallel to each other and extending along the entire length of the straight edge. The cutting guide also includes a squaring head having a thickness substantially equal to the thickness of a standard single mat board, approximately 1/16 of an inch. The squaring edge is attached to the bottom surface of the straight edge at the first end of the straight edge. The squaring head includes a squaring edge adapted to engage a first edge of a piece of mat board when the bottom surface of the straight edge is placed on the piece of mat board. The squaring head is attached to the straight edge such that the squaring edge of the squaring head is perpendicular to the first and second edge of the straight edge. Several additional features of and attachments for the mat board cutting guide are also disclosed.

6 Claims, 2 Drawing Sheets

MAT BOARD CUTTING GUIDE

BACKGROUND OF THE INVENTION

The present invention relates generally to cutting guides or straight edges, and more specifically to a mat board cutting guide having a perpendicular aligning head for controlling the positioning of the cutting guide.

In the picture flaming business and for many arts and crafts, mat board is often used for framing pictures with a decorative border or many other purposes which require cutting mat board down to a certain size. In most cases this requires cutting large standard mat boards down to a desired rectangular shape with square right angle corners. Traditionally this is done using ether a large paper cutter tool, or a conventional straight edge which the person cutting the mat board must hold in the proper position as they cut the mat board. In the case of the paper cutter, these tools are expensive and seldom readily available except in situations where a large volume of boards are being cut and the large expense of the paper cutting tool large enough to cut full size mat board is justified. In the case of the conventional straight edge, although they are readily available, it requires some skill to properly align the straight edge and it is difficult to hold the straight edge in position with only one hand as the mat board is being cut with the other hand. The present invention provides a mat board cutting guide which is easily held in place while cutting the mat board.

SUMMARY OF THE INVENTION

As will be described in more detail hereinafter, a mat board cutting guide for use in cutting mat board for framed pictures, for example, is disclosed. The cutting guide includes an elongated straight edge having a top and a bottom surface, a first and a second end, and a first and a second edge. The first and the second edge are parallel to each other and extending along the entire length of the straight edge. The cutting guide also includes a squaring head having a thickness substantially equal to the thickness of a standard single mat board. In one embodiment this is approximately 1/16 of an inch. The squaring edge is attached to the bottom surface of the straight edge at the first end of the straight edge. The squaring head includes a squaring edge adapted to engage a first edge of a piece of mat board when the bottom surface of the straight edge is placed on the piece of mat board. The squaring head is ether fixed or slidably attached to the straight edge such that the squaring edge of the squaring head is perpendicular to the first and second edge of the straight edge. The squaring head includes a pair of slots extending from the squaring edge of the squaring head partially into the squaring head adjacent to the first and second edge of the straight edge. These slots provide an opening for a user to place a tip of a cutting knife prior to beginning the cutting of the mat board or provide an opening for the tip of a cutting knife as the user is completing the cutting of the mat board.

Also disclosed is a detachable squaring head attachment including means for attaching the squaring head attachment to the bottom surface of the squaring head. The attachment increases the thickness of the squaring head to a thickness substantially equal to the thickness of a standard double thickness mat board. In one embodiment this is approximately 1/8 of an inch.

In another feature of the present invention, a detachable clamping head having a thickness substantially equal to the thickness of a standard single mat board is disclosed. In one embodiment this thickness is approximately 1/16 of an inch. The detachable clamping head includes attaching means for detachably connecting the clamping head to the bottom surface of the straight edge at any given point along the length of the straight edge. The detachable clamping head includes a clamping edge adapted to engage a second edge of the piece of mat board generally parallel to the first edge of the piece of mat board when the bottom surface of the straight edge is placed on the piece of the mat board. Therefore, when the clamping head is attached to the straight edge such that the squaring head engages the first edge of the mat board and the clamping edge of the clamping head engages the second edge of the mat board, the entire mat board cutting guide is clamped in a position on the mat board with the straight edge perpendicular to the first edge of the mat board providing a stable cutting guide.

In another feature of the present invention, a cutting tool guide connected to the top surface of the straight edge parallel with the first and second edges of the straight edge and extending along substantially the entire length of the straight edge is disclosed. The cutting tool guide is adapted to slidably receive a cutting tool such that the cutting tool may slide along the entire length of the cutting tool guide while a cutting tool blade is cutting the piece of mat board parallel to the straight edge.

BRIEF DESCRIPTION OF THE DRAWINGS

The features of the present invention may best be understood by reference to the following description of the presently preferred embodiments together with the accompanying drawings in which.

DETAILED DESCRIPTION OF THE PREFERRED EMBODIMENTS

Figure 1:
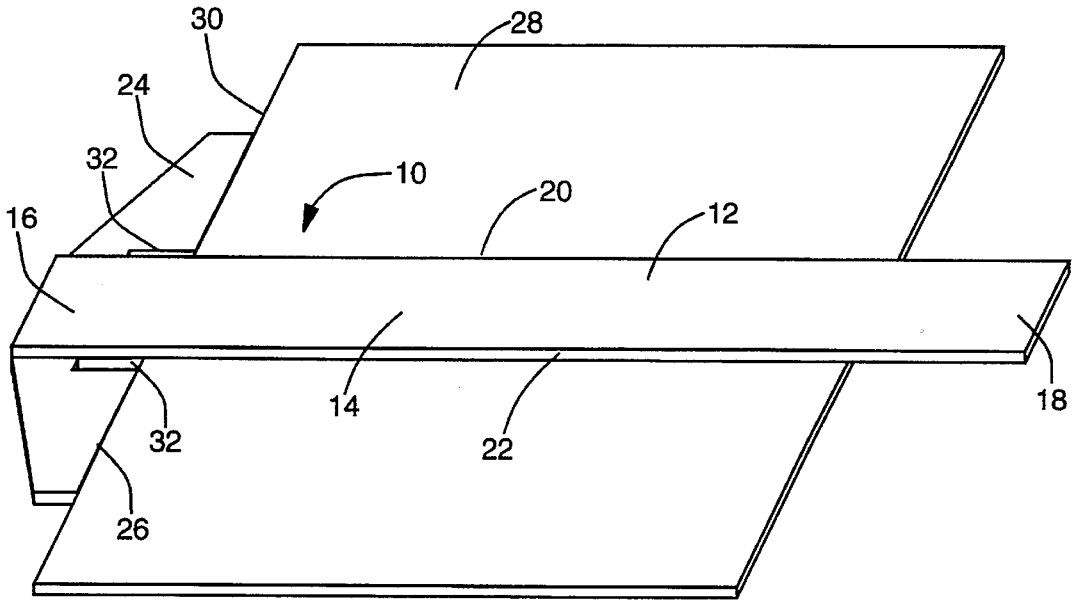
FIG. 1 is a diagrammatic orthographic view of a first embodiment of a mat board cutting guide designed in accordance with the present invention.

Referring initially to FIG. 1 a mat board cutting guide designed in accordance with the present invention and generally designated by reference numeral 10 will be described. Mat board cutting guide 10 includes an elongated straight edge 12 having a top surface 14, a bottom surface not seen in FIG. 1, a first end 16, a second end 18, a first edge 20 and a second edge 22. First edge 20 and second edge 22 are parallel to one another and extend along the entire length of straight edge 12. Mat board cutting guide 10 also includes a squaring head 24 which, in accordance with the present invention, has a thickness substantially equal to the thickness of a standard single mat board. By way of example in the embodiment shown, this thickness is approximately 1/16 of an inch. Squaring head 24 is attached to the bottom surface of straight edge 12 at the first end 16 of straight edge 12. Squaring head 24 includes a squaring edge 26 which is designed to engage a piece of mat board 28 at a first mat board edge 30 when the bottom surface of straight edge 12 is placed on the piece of mat board 28.

As shown in FIG. 1, when mat board cutting guide 10 is placed on mat board 28 with the bottom surface of straight edge 12 against the mat board and with the squaring edge 26 of squaring head 24 engaging first mat board edge 30, straight edge 12 is held perpendicular to the first mat board edge 30. This allows a user of the mat board cutting guide to use one of the edges of the straight edge 12 to cut the mat board 28 while the squaring head 24 assists the user in holding the straight edge in the perpendicular position. In accordance with the present invention, since the thickness of the squaring head 24 is essentially the same as the thickness of the mat board 28, the mat cutting guide fits tightly against the mat board providing a stable guide for cutting the mat board.

Still referring to FIG. 1, in accordance with the present invention, squaring head 24 of mat cutting guide 10 includes a pair of slots 32 extending from the squaring edge 26 of squaring head 24 into the squaring head immediately adjacent to edges 20 and 22 of straight edge 12. These slots 32 provide openings for the user to place the tip of a cutting knife prior to the cutting of mat board 28. By placing the tip of the knife into the openings the user is able to cleanly begin cutting the mat board at mat board edge 30 without having to force the tip of the knife through the mat board which would be the case if slots 32 were not provided. Alternatively, if the mat board is being cut in the other direction, slots 32 provide space for the knife blade to cleanly finish the cut through mat board edge 30 without running into squaring head 24.

In a presently preferred embodiment of the present invention, both straight edge 12 and squaring head 24 are made from an appropriate gauge sheet metal. However, it should be understood that the present invention is not limited to a mat board cutting guide made from this material, but instead would apply to a mat board cutting guide as described above regardless of the material used to construct the guide.

Figure 2:
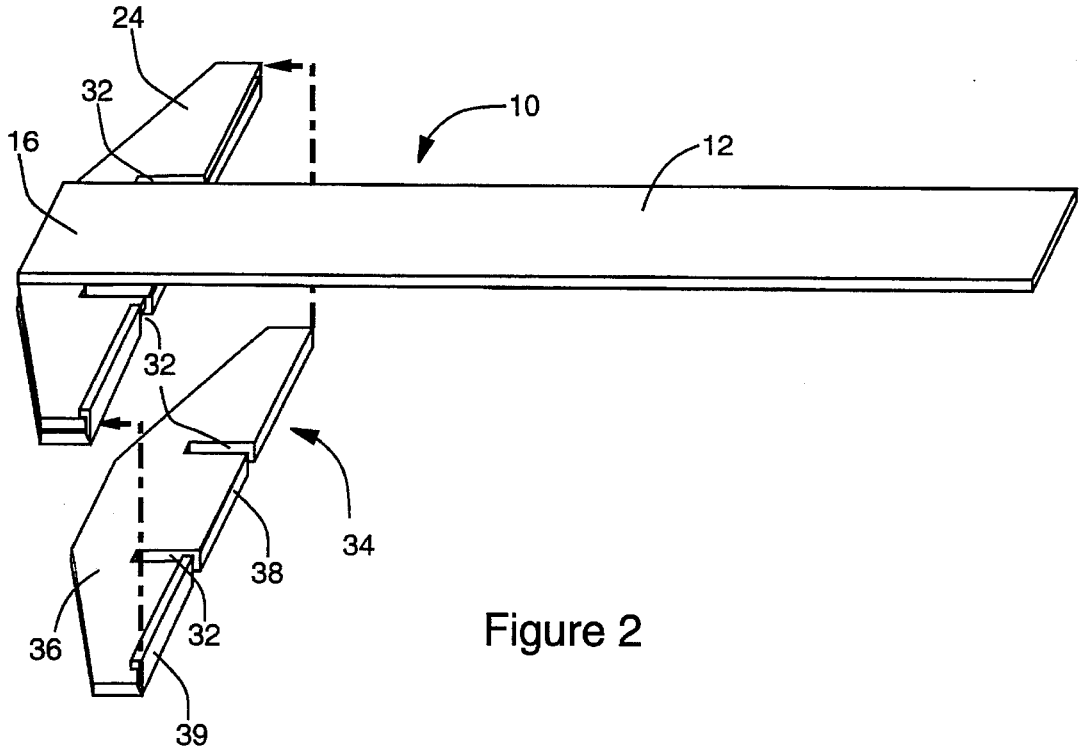
FIG. 2 is a diagrammatic orthographic view of the squaring head of the mat board cutting guide shown in FIG. 1 and also illustrating a squaring head attachment, with the attachment in a use position.

Referring now to FIG. 2, which is an orthographic view of squaring head 24 of mat board cutting guide 10 shown in FIG. 1, a squaring head attachment generally designated by reference numeral 34 will be described. In a presently preferred embodiment of squaring head attachment 34, the attachment includes a main body 36 having a shape and thickness essentially equivalent to squaring head 24, the thickness being approximately 1/16 of an inch. Squaring head attachment 34 also includes a squaring edge 38 having a sideways U-shaped channel 39 extending along at least a portion of its length and upward from squaring edge 38. Sideways U-shaped channel 39 is designed to form an opening defined by the sideways U-shape channel which has the proper thickness, approximately 1/16 of an inch, to receive the squaring edge 26 of the squaring head 24 of mat board cutting guide 10.

With squaring head attachment 34 attached to squaring head 24 as shown in FIG. 2, the overall thickness of the combination becomes substantially equal to the thickness of ether two standard single mat boards or the thickness of a standard double mat board, approximately 1/8 of an inch. This provides a tight fit for the overall mat board cutting guide when cutting a double mat board. However, this arrangement also provides the proper fit for the guide when two single mat boards are being cut and only an edge of the bottom mat board is being used as a reference for the squaring head of the guide.

Although only one specific arrangement for attaching squaring head attachment 34 to squaring head 24 has been described, it should be understood that the present invention is not limited to an arrangement attached in this manner. Instead, the present invention would apply to any conventional arrangement for attaching squaring head attachment 34 to squaring head 24. For instance, conventional bolts or screws may be used for the attaching arrangement. Alteratively, clips positioned around the perimeter of the attachment may provide the attaching arrangement. Also, although squaring head attachment 34 has been described as having a shape similar to the shape of squaring head 24, this is not a requirement of the present invention. Therefore, attachments having a wide variety of shapes would fall within the scope of the present invention. Furthermore, squaring head attachment 34 may include slots 32 as described above for squaring head 24 which provide an opening for the user to place the tip of a cutting knife prior to the cutting of mat board.

Figure 3:
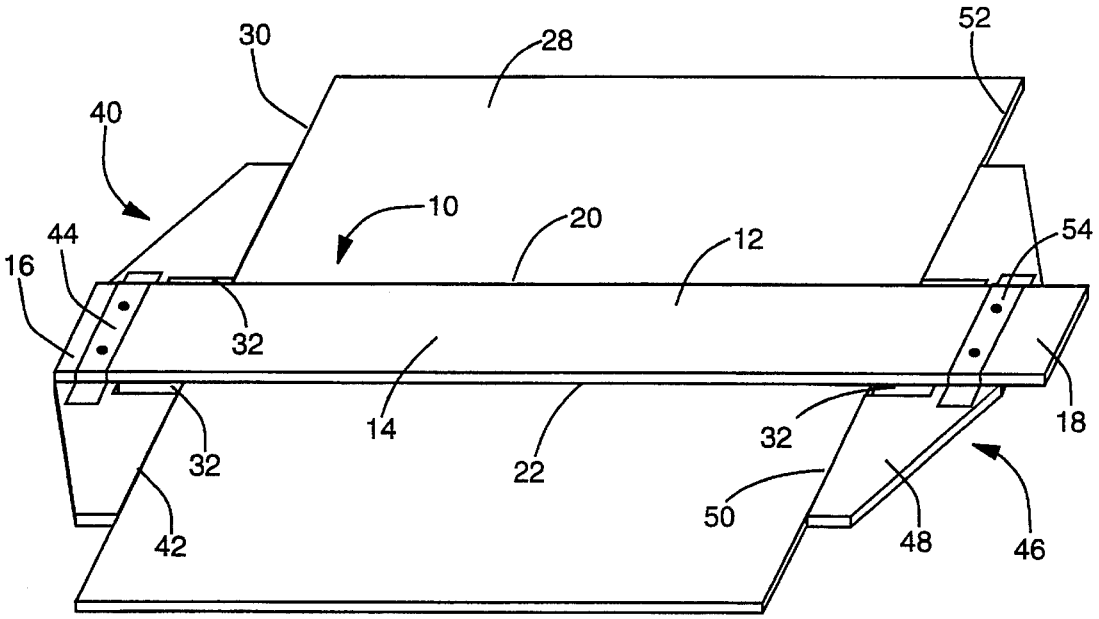
FIG. 3 is a diagrammatic orthographic view of a second embodiment of a mat board cutting guide designed in accordance with the present invention including a slidable squaring head, a detachable clamping head, and a squaring head attachment.

Referring now to FIG. 3, a second embodiment of the present invention having a detachable squaring head generally designated by reference numeral 40 will be described. As was described above for squaring head 24, detachable squaring head 40 also has a thickness substantially equal to the thickness of a standard single mat board, approximately 1/16 of an inch. Detachable squaring head 40 also includes a squaring edge 42 designed to engage the first edge 30 of the mat board 28 as was described above for squaring head 24. However, detachable squaring head 40 includes an arrangement 44 for slidably attaching detachable squaring head 40 to straight edge 12. Also, as described above in detail for squaring head 24, detachable squaring head 40 includes slots 32 for providing openings for the user to place the tip of a cutting knife.

Arrangement 44 is designed to hold detachable squaring head 40 against the bottom surface of straight edge 12 such that squaring edge 42 is held perpendicular to edges 20 and 22 of straight edge 12. Arrangement 44 may take on a wide variety of forms. For instance, arrangement 44 may include a sleeve for receiving straightedge 12 and holding it perpendicular to squaring edge 42. A set screw may be used to secure squaring head 40 in place. Alternatively, guides attached to the top surface of squaring head 40 may be used to align straight edge 12 perpendicular to squaring edge 42 and a locking cam may be used to secure detachable squaring head 40 to straight edge 12. Although only two specific arrangements for slidably attaching head 40 to straight edge 12 have been described, it should be understood that the present invention would equally apply to other arrangements for slidably attaching squaring head 40 to straight edge 12.

Still referring to FIG. 3, a clamping head designed in accordance with the present invention and generally designated by reference numeral 46 will be described. Clamping head 46 includes a main body 48 having a thickness substantially equal to the thickness of a standard single mat board, approximately 1/16 of an inch. Main body 48 of clamping head 46 includes a clamping edge 50 designed to engage a second edge 52 of mat board 28. Clamping head 46 also includes an arrangement 54 for slidably attaching clamping head 46 to straight edge 12. Arrangement 54 may take on a wide variety of arrangements as was described in detail above for arrangement 44.

As shown in FIG. 3, when the overall mat board cutting guide is placed on a piece of mat board with squaring edge 42 engaging mat board edge 30 and with clamping head 46 attached to straight edge 12 such that clamping edge 50 of clamping head 46 engages mat board edge 52, the entire mat board cutting guide is clamped in a position on the mat board with the straight edge 12 perpendicular to edge 30 of the mat board. By clamping the mat board cutting guide to the mat board as described above and in accordance with the present invention, the user is not required to hold the cutting guide in position and the cutting guide is prevented from slipping out of the proper position as the mat board is being cut.

Figure 4:
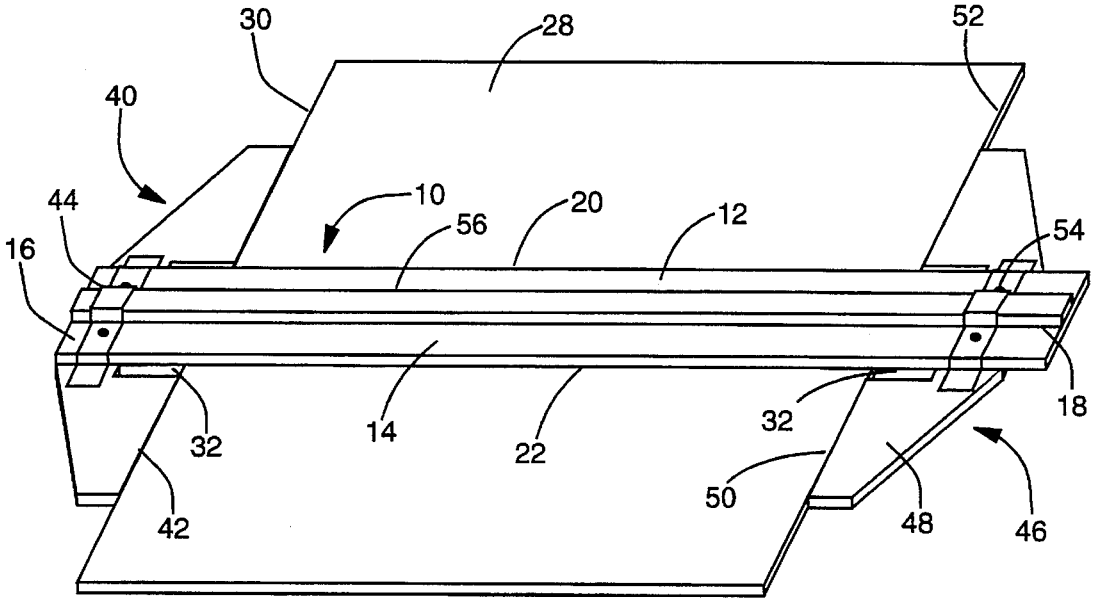
FIG. 4 is a diagrammatic orthographic view of a third embodiment of a mat board cutting guide designed in accordance with the present invention including a cutting tool guide and a detachable clamping head.

Referring now to FIG. 4, another embodiment of the present invention will be described. As shown in FIG. 4, this embodiment of the present invention includes straight edge 12, detachable squaring head 40, and clamping head 46 as described above. However, in this embodiment, straight edge 12 includes a cutting tool guide 56. Cutting tool guide 56 may take the form of a rod or a channel fixed to the top surface of straight edge 12. Cutting tool guide 56 is attached to straight edge 12 such that it is positioned parallel with edges 20 and 22 of straight edge 12 and extends substantially along the entire length of the straight edge. In this embodiment, attaching arrangements 44 and 54 for detachable squaring head 40 and clamping head 46, respectively, include an arrangement or sleeve for sliding along cutting tool guide 56.

Although cutting tool guide 56 has been described as taking the form of a rod of a channel fixed to straight edge 12, it should be understood that cutting tool guide may take a wide variety of forms. For instance, the cross sectional shape of guide 56 may be square, round, or any other shape which provides a proper shape for guiding any given cutting tool (not shown) along the length of the straight edge.

With the immediately above described embodiment, the user may clamp the mat board cutting guide to a piece of mat board as described above. Then using a conventional cutting tool (not shown), the user may cut the mat board by simply running the cutting tool along the cutting tool guide. Conventional cutting tools are readily available and typically include a main body designed to be easily held by a user along with adjustable arrangements for clamping a cutting blade in a desired cutting position. These adjustable arrangements for clamping a cutting blade often include adjustments for the cutting depth of the blade and cutting angle of the blade. These adjustments allow the user to position the blade at the proper depth and angle for making the desired cut, which may be vertical or beveled, as the cutting tool slides over the surface of the mat board.

Cutting tool guide 56 may be arranged to cooperate with any given cutting tool to prevent the tool from moving in any direction other than along the longitudinal axis of the mat board cutting guide. This may be accomplished using an arrangement provided on the cutting tool for slidably attaching the cutting tool to the cutting tool guide in a way which allows the cutting tool to slide only along the longitudinal axis of the mat board cutting guide.

Although only a few embodiments of the present invention have been described in detail, it should be understood that the present invention may be embodied in many other specific forms without departing from the spirit or scope of the invention. It should also be understood that the various features of the embodiments of the present invention described above may be combined in a variety of ways. For example, the mat cutting guide may include a fixed squaring head, as shown in FIG. 1, and a tool cutting guide, as shown in FIG. 4. Alternatively, the overall mat cutting guide of the present invention may be designed to pivotally attach to a mat board cutting table providing a dedicated work table for cutting mat board.

Therefore, the present example is to be considered as illustrative and not restrictive, and the invention is not to be limited to the details given herein, but may be modified within the scope of the appended claims.

What is claimed is:

1. A cutting guide comprising:

a) an elongated straight edge having a top and a bottom surface, a first and a second end, and a first and a second edge, the first and the second edge being parallel to each other and extending along the entire length of the straight edge;

b) a squaring head being attached to the straight edge at the first end of the straight edge, the squaring head including a squaring edge adapted to engage a first edge of a piece to be cut when the bottom surface of the straight edge is placed on the piece to be cut, the squaring head being attached to the straight edge such that the squaring edge of the squaring head is perpendicular to the first and second edge of the straight edge, the squaring head including a pair of slots extending from the squaring edge of the squaring head partially into the squaring head adjacent to the first and second edges of the straight edge respectively thereby providing cutting openings into which a blade tip may be placed prior to beginning the cutting of the piece to be cut or providing an opening for the blade tip to run into at the completion of a cut; and a clamping head including attaching means for detachably connecting the clamping head to the bottom surface of the straight edge at any given point along the length of the straight edge, the detachable clamping head including a clamping edge adapted to engage a second edge of the piece to be cut that extends generally parallel to the first edge of the piece to be cut when the bottom surface of the straight edge is placed on the piece to be cut, the clamping head including a pair of slots extending from the clamping edge partially into the clamping head adjacent to the first and second edges of the straight edge respectively thereby providing cutting openings into which a blade tip may be placed prior to beginning the cutting of the piece to be cut or providing an opening for the blade tip to run into at the completion of a cut;

whereby when the cutting guide is positioned on the piece to be cut with the squaring edge of the squaring head engaging the first edge of the piece to be cut, the straight edge of the cutting guide is held perpendicular to the first edge of the piece to be cut.

2. A cutting guide as set forth in claim 1 wherein the squaring head is slidably attached to the straight edge.

3. A cutting guide as set forth in claim 1 wherein the squaring head has a thickness substantially equal to the thickness of a standard single mat board, approximately 1/16 of an inch, the cutting guide further comprising a detachable squaring head attachment including means for attaching the squaring head attachment to a bottom surface of the squaring head, the attachment increasing the thickness of the squaring head to a thickness substantially equal to the thickness of a standard double thickness mat board, approximately 1/8 of an inch.

4. A cutting guide as set forth in claim 3 wherein the means for attaching the squaring head attachment includes a squaring edge having a channel along the squaring edge of the squaring head attachment, the channel being adapted to slidably receive the squaring edge of the squaring head thereby attaching the squaring head attachment to the squaring head.

5. A cutting guide as set forth in claim 1 wherein the clamping head has a thickness substantially equal to the thickness of a standard single mat board, approximately 1/16 of an inch.

6. A cutting guide as set forth in claim 1 further comprising a cutting tool guide connected to the top surface of the straight edge parallel with the first and second edges of the straight edge and extending along substantially the entire length of the straight edge, the cutting tool guide being adapted to slidably receive a cutting tool such that the cutting tool may be slid along the entire length of the cutting tool guide while a cutting tool blade is cutting the piece parallel to the straight edge.

* * * * *